US005541630A

United States Patent [19]

Ema et al.

[11] Patent Number: 5,541,630

[45] Date of Patent: Jul. 30, 1996

[54] INKJET PRINT HEAD AND INKJET PRINTER

[75] Inventors: Yasushi Ema; Hisayoshi Fujimoto; Toshio Amano, all of Kyoto, Japan

[73] Assignee: Rohm Co., Ltd., Kyoto, Japan

[21] Appl. No.: 104,884

[22] Filed: Aug. 10, 1993

[30] Foreign Application Priority Data

| | | | |
|---|---|---|---|
| Aug. 11, 1992 | [JP] | Japan | 4-214373 |
| Sep. 3, 1992 | [JP] | Japan | 4-236013 |
| Feb. 5, 1993 | [JP] | Japan | 5-018517 |

[51] Int. Cl.[6] ..... B41J 2/045

[52] U.S. Cl. ..... 347/70

[58] Field of Search ..... 347/40, 50, 68, 347/70, 71, 94

[56] References Cited

U.S. PATENT DOCUMENTS

| | | | |
|---|---|---|---|
| 4,115,789 | 9/1978 | Fischbeck | 347/68 |
| 4,521,788 | 6/1985 | Kimura et al. | 347/40 |
| 5,126,764 | 6/1992 | Miyauchi | 346/134 X |

FOREIGN PATENT DOCUMENTS

| | | | |
|---|---|---|---|
| 58-5263 | 1/1983 | Japan | 347/94 |

*Primary Examiner*—Benjamin R. Fuller
*Assistant Examiner*—Alrick Bobb
*Attorney, Agent, or Firm*—Wolf, Greenfield & Sacks P.C.

[57] ABSTRACT

An inkjet print head and inkjet printer can stabilize the characteristic of ink discharge and improve the quality of printing by providing a vibrating plate, a part of which is vibrated by deforming a piezoelectric element corresponding to a pressure chamber without transmission of the vibration to any other vibrating plate part corresponding to another pressure chamber. The inkjet print head and inkjet printer can prevent any floating in the grounding electrode. In the inkjet print head and inkjet printer, furthermore, the characteristic of ink droplet discharge can be stabilized by reducing and equalizing the distance between the grounding electrode and each of the piezoelectric element electrode. A head unit is mounted on a base which includes a support for supporting the parts of the vibrating plate corresponding to the respective nozzles. A flexible cable having electrode portions connected to the piezoelectric elements has a grounding electrode located at a position corresponding to a circular area which is defined by the pressure chambers and piezoelectric elements.

38 Claims, 23 Drawing Sheets

INKJET PRINT HEAD AND INKJET PRINTER

BACKGROUND OF THE INVENTION

1. Field of the Invention

The present invention relates to an inkjet print head suitable for use in printers, facsimiles, plotters, bar-code printers, digital copying machines and the like and an inkjet printer having such an inkjet print head. Particularly, the present invention concerns an inkjet print head and inkjet printer which can respond to image signals to inject ink through thin nozzles, the injected ink being deposited on a recording medium such as paper and the like.

2. Description of the Related Art

Conventional inkjet printers are classified into the continuous type and the on-demand type. Ink used may be water based or oil based.

The continuous type inkjet printers continuously inject the ink through nozzles, the ink not used on recording being collected and re-used. The continuous type inkjet printers have higher head responsiveness, but are complicated and expensive, requiring an ink collecting mechanism. On the other hand, the on-demand type inkjet printers inject the ink on demand. The on-demand type inkjet printers have lower head responsiveness, but are more simple and inexpensive in structure.

The on-demand type inkjet printers are further divided into an electrostatic attraction force type in which the ink is drawn out through the nozzles under the action of electrostatic force and a pressure pulse type known as an in-pulse jet in which the ink is pressurized in and ejected from a pressure chamber through the nozzles.

The pressure pulse type inkjet printers are still further classified into piezoelectric type and bubble type. The piezoelectric type inkjet printers pressurize the ink by the use of a piezoelectric (electric strain) element and are further divided into single-chamber type in which the ink is supplied through a pressure chamber and two-chamber type which comprises a pressure chamber and an ink supply chamber.

The single-chamber type inkjet printers are further divided into Kyser type in which a planar pressure chamber is used and Zoltan type in which a cylindrical pressure chamber is used. The two-chamber type inkjet printers include Stemme type inkjet printers in which the ink is supplied directly near the nozzles.

FIG. 1 is a view showing the basic principle of a piezoelectric type head unit in the Kyser type inkjet printer. The head unit comprises a base plate 101 and ink supply passage 103, pressure chamber 102 and nozzle 106 which are formed in the surface of the base plate 101 so as to communicate with one another. The surface of the base plate 101 includes a vibrating plate 107 disposed thereon. The top of the vibrating plate 107 supports a piezoelectric element 108 which is disposed opposite to the pressure chamber 102. A signal generator 111 is connected to the piezoelectric element 108 such that a voltage is applied across the opposite sides of the piezoelectric element 108. The ink supply passage 103 is connected to an ink vessel 109 through a pipe 104.

In such an arrangement, when the voltage is applied from the signal generator 111 to the piezoelectric element 108, the piezoelectric element 108 causes the vibrating plate 107 to bend so that the ink 110 will be injected from the pressure chamber 102 through the nozzle 106 toward a recording medium 115 in the form of an ink droplet 110*a*.

After the ink has been injected and when the piezoelectric element 108 is released from the voltage, the vibrating plate 107 returns to its original position and a new amount of ink corresponding to the amount of the injected ink will be replenished from the ink vessel 109 through the ink supply passage and pipe 103, 104 under the capillary action of the nozzle.

FIG. 2 is a cross-sectional view of a conventional inkjet print head which utilizes the aforementioned piezoelectric type head unit. The piezoelectric type head unit is fixedly mounted on a base 112 through a holding frame 114. More particularly, the piezoelectric type head unit is first placed on the base 112. The holding frame 114 is cylindrical and includes an inwardly directed flange 114*a* formed therein at one end. The holding frame 114 is then positioned to engage a peripheral shoulder 112*a* in the base 112. The holding frame 114*a* includes threaded holes which are screwed by bolts 116 passed through through-apertures 114 in the base 112 to fix the holding frame 114 relative to the base 112. Thus, the outer periphery of the base plate 101 in the piezoelectric type head unit will be firmly held against the base 112 by being engaged by the inwardly directed flange 114*a* of the fixed holding frame 114. The piezoelectric type head unit is further urged and held against the holding frame 114 by a resilient member 117 which is received in a recess 112*b* formed in the base 112. A drive voltage is applied to the piezoelectric element 108 through flexible cables 109.

FIG. 3 is a cross-sectional view of another conventional inkjet print head which utilizes the piezoelectric type head unit. The base plate 101 of the piezoelectric type head unit is first placed in a counterbored hole 118*a* which is formed in a cylindrical base 118 at one end. The base plate 101 is then threadedly screwed to the base 118 through a machine screw 119. In such a manner, the piezoelectric type head unit is fixedly mounted on the base 118.

A piezoelectric type head unit including pressure chambers and piezoelectric elements arranged in a circle as shown in FIG. 4 will further be described below.

As shown in FIG. 4, the piezoelectric type head unit comprises a base plate of photosensitive glass, a plurality of radial pressure chambers 102 formed in the base plate, a common ink passage 103 formed in the base plate to surround and communicate with the pressure chambers 102, an ink inlet port 5 formed in the base plate for supplying the ink to the common ink passage 103 and a plurality of nozzles formed substantially centrally through the base plate. The pressure chambers, common ink passage and ink inlet port may be machined in the base plate by any suitable manner such as etching. The number of nozzles per unit area can be increased by radially forming the pressure chambers 102. A piezoelectric element 108 may be made of PZT or the like and mounted on the base plate at a position opposite to a vibrating plate corresponding to the respective one of the pressure chambers 102.

Each of the piezoelectric elements 108 is connected to a signal generator through a flexible cable means such that a voltage is applied to that piezoelectric element. The flexible cable means has an electrode means connected to the piezoelectric element and another electrode means for grounding the vibrating plate. As shown in FIGS. 4 and 5, a flexible cable 59 of the prior art includes a flexible cable tip portion 59*a* which has grounding electrodes 50' formed in corners of the tip portion 59*a*.

Since the inkjet print heads of the prior art as shown in FIGS. 2 and 3 are not very well supported near the center of the vibrating plate 107 opposite to the nozzles 106, the flexibility in the vibrating plate part corresponding to one or more energized piezoelectric elements causes unnecessary flexing in the vibrating plate part corresponding to the not-energized piezoelectric element adjacent to an energized piezoelectric element. This will provide an unstable discharge of ink droplets to reduce the quality of printing and to generate noise. The unnecessary resonance in the vibrating plate reduces the service life of the head and also provides various other problems.

In order to overcome the above problems, the piezoelectric element may be pressurized by such a resilient member 117 as is shown in FIG. 2. However, the vibrating plate is also pressurized through that piezoelectric element. When the pressure increases, therefore, the output of the ink will be decreased to reduce the energy effective in discharge.

In the flexible cable of the prior art, the grounding electrodes 50' are formed in the corners of the tip portion 59*a*, as described with reference to FIGS. 4 and 5. Thus, the area of the electrodes is not increased. As a result, a so-called "floating" in the grounding electrode may be produced to reduce the amount of electric current in the flexible cable and also the distance between the grounding electrode and the corresponding piezoelectric element electrode may be increased in some parts to increase the voltage drop and to so heat the head. The voltage cannot be applied by the floating in the grouding electrode and the resistance between the grounding electrode and the piezoelectric element electrode is varied due to the different distance between the grounding electrode and the corresponding piezoelectric element electrode to render the voltage drop variable. Thus, the piezoelectric element will be flexed with different deflections to render the change of volume in the pressure chamber variable. Accordingly, the diameter and speed of the discharged ink droplets become variable resulting in destabilizing the discharge characteristic of the ink droplets.

SUMMARY OF THE INVENTION

In order to overcome the above problems, it is an object of the present invention to provide an inkjet print head and inkjet printer which can prevent the vibration of a vibrating plate part produced from the deformation of the corresponding piezoelectric element from transmitting to another vibrating plate part corresponding to the other piezoelectric element, thereby stabilizing the ink discharge characteristic, improving the quality of printing, reducing the noise and preventing the service life of the head from being reduced due to the vibration of the vibrating plate.

Another object of the present invention is to provide an inkjet print head and inkjet printer which can prevent the floating in the grounding electrode to decrease and equalize the distance between a grounding electrode and a piezoelectric element electrode, thereby stabilizing the ink droplet discharge characteristic.

The inkjet print head and inkjet printer of the present invention may include a support for a vibrating plate at the respective one of nozzle forming locations when a plurality of pressure chambers are arranged in two lines or when a plurality of pressure chambers are arranged in a circle. Therefore, the flexibility in a vibrating plate part due to the deflection of any energized piezoelectric element will not be transmitted to the other vibrating plate part corresponding to any other non-energized piezoelectric element adjacent to the energized piezoelectric element. This can prevent the discharge of ink through any unnecessary nozzle. As a result, the quality of printing can be improved with a reduction of noise and without reduction of the service head life due to vibration.

Since the grounding electrodes are located within the circular area defined by the pressure chambers and piezoelectric elements, the area for the grounding electrodes can be increased. This prevents the floating in the grounding electrode, thereby preventing the head from being heated and stabilizing the ink discharge characteristic.

DETAILED DESCRIPTION OF THE PREFERRED EMBODIMENTS

Figure 1:
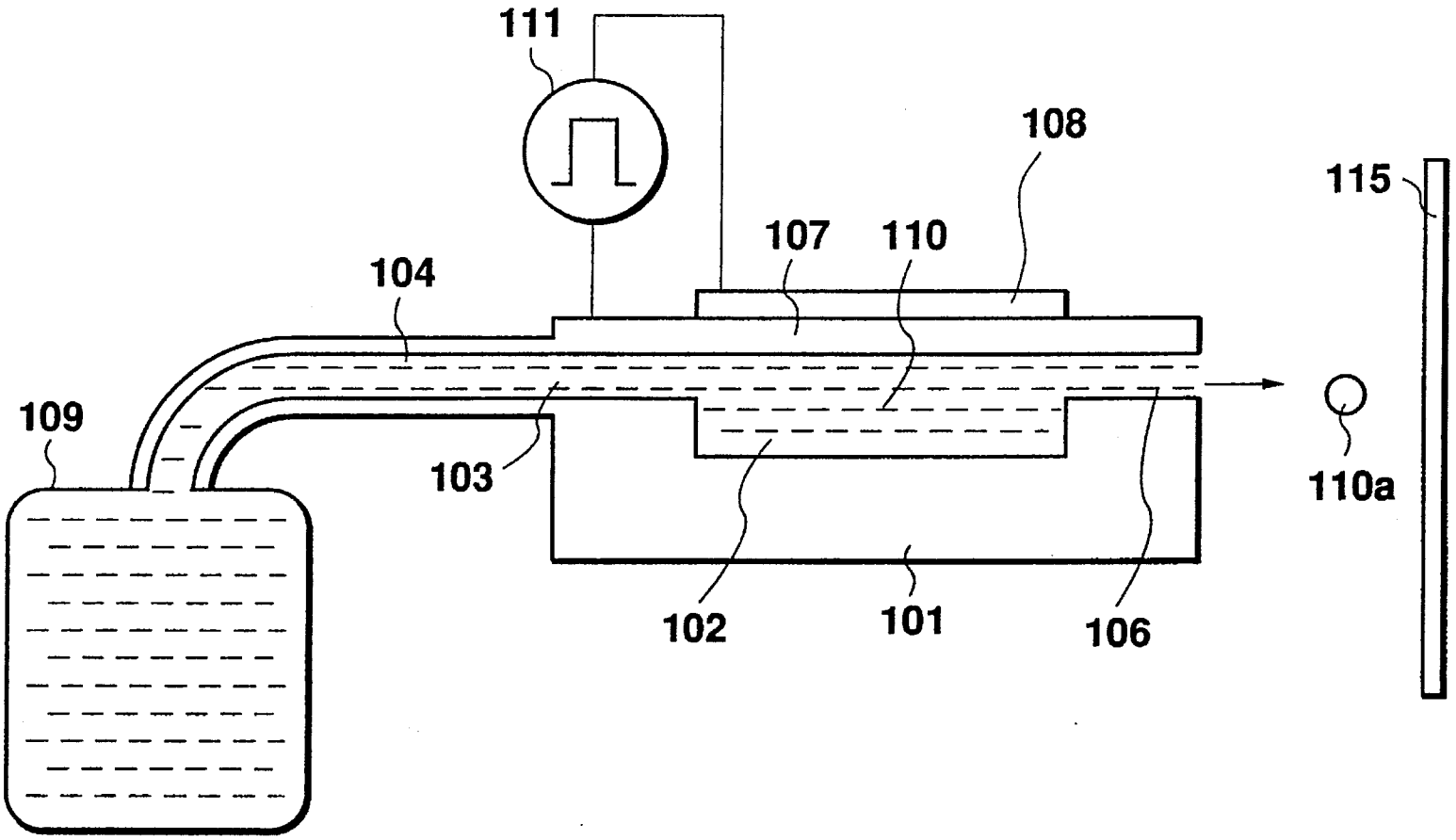
Fig. 1 (PRIOR ART)
FIG. 1 is a view illustrating the principle of a piezoelectric type head unit.
Figure 2:
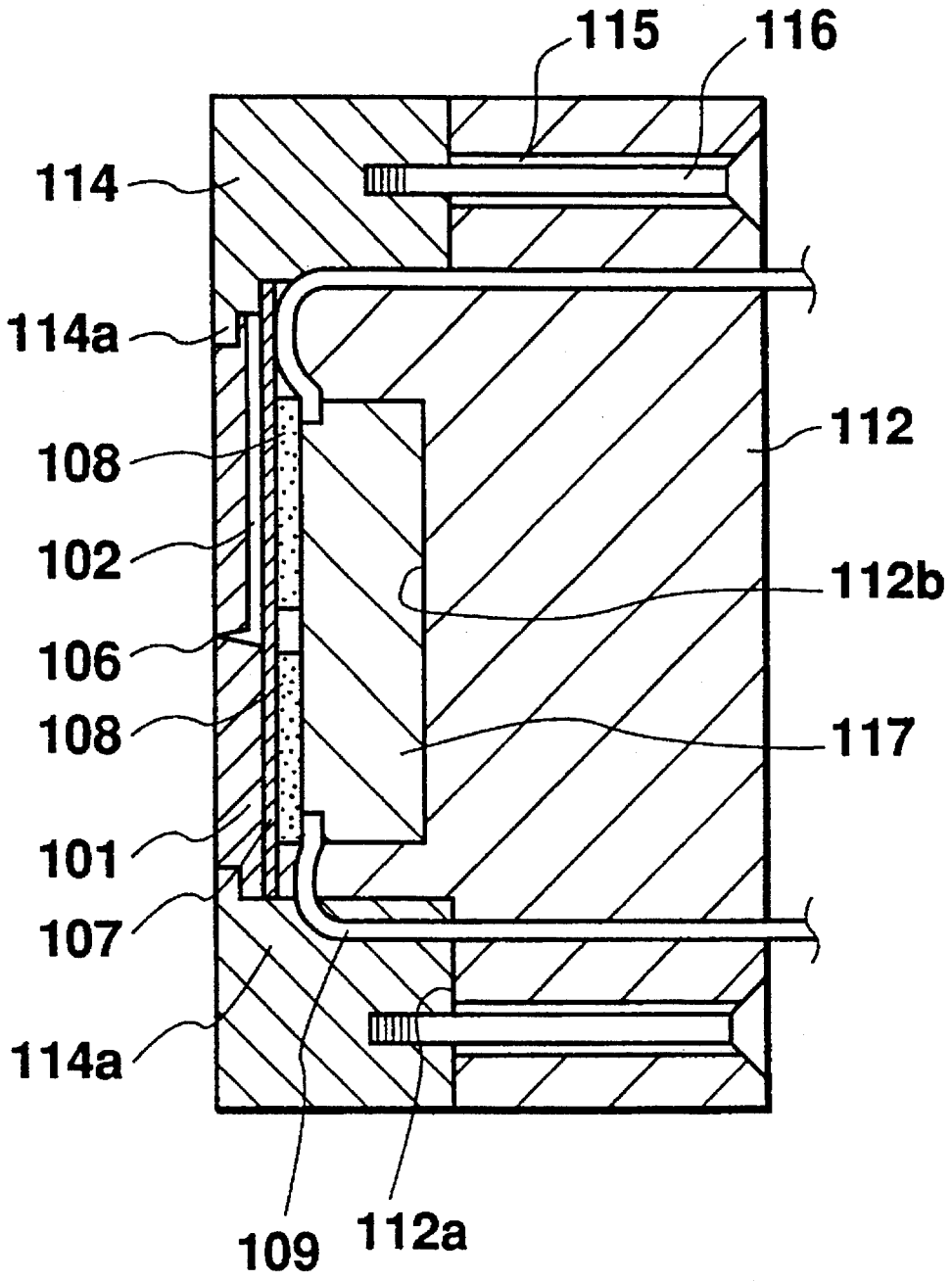
Fig. 2 (PRIOR ART)
FIG. 2 is a cross-sectional view of an inkjet print head constructed in accordance with the prior art and including a base plate on which the piezoelectric type head unit is mounted.
Figure 3:
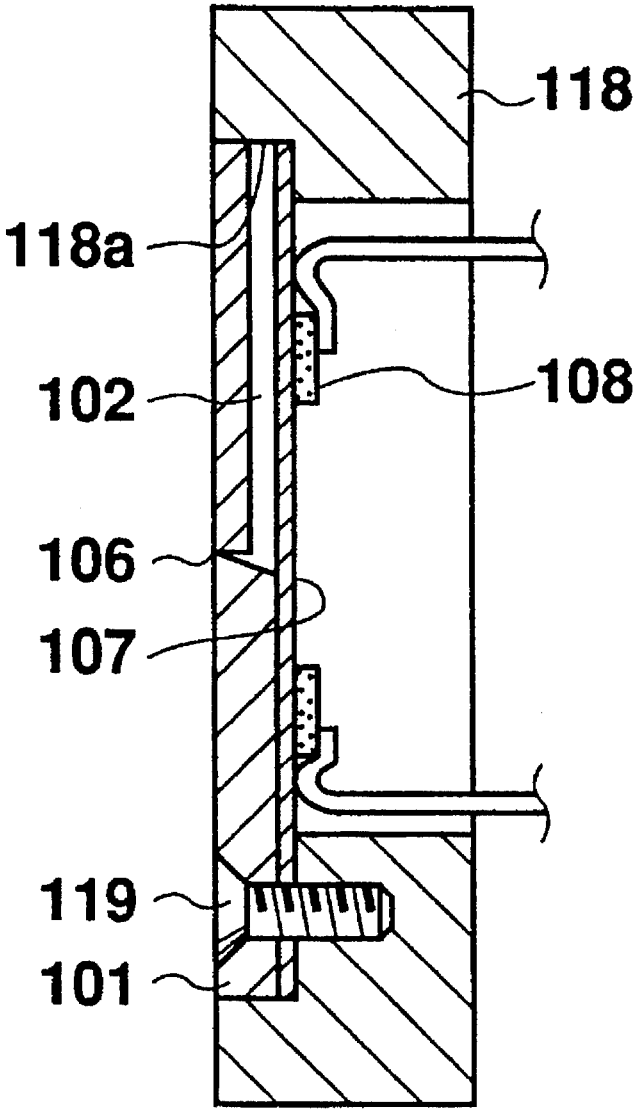
Fig. 3 (PRIOR ART)
FIG. 3 is a cross-sectional view of another inkjet print head constructed in accordance with the prior art and including a base plate on which the piezoelectric type head unit is mounted.
Figure 4:
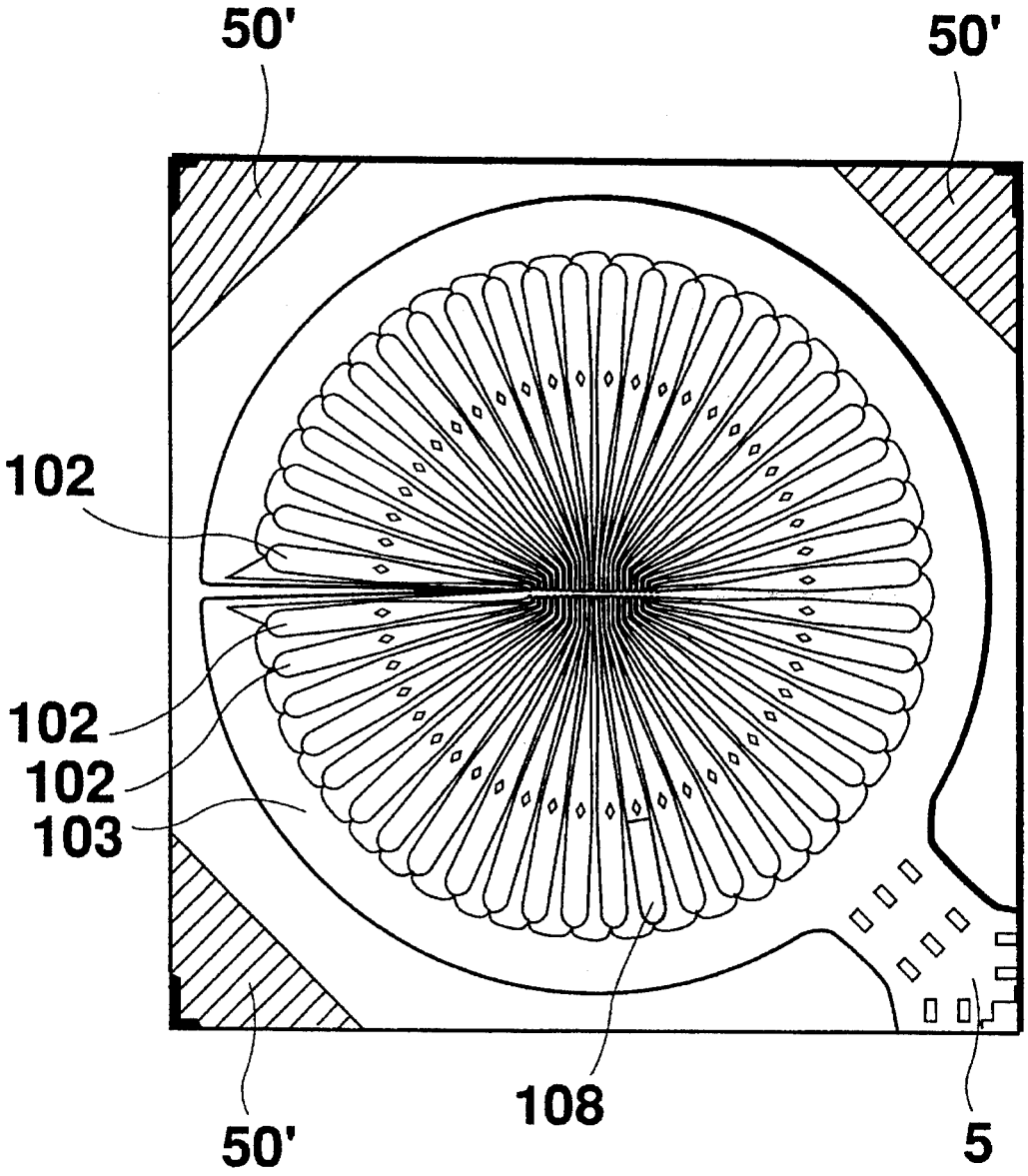
Fig. 4 (PRIOR ART)
FIG. 4 is a view illustrating the positions of grounding electrodes in the piezoelectric type head unit of the prior art.
Figure 5:
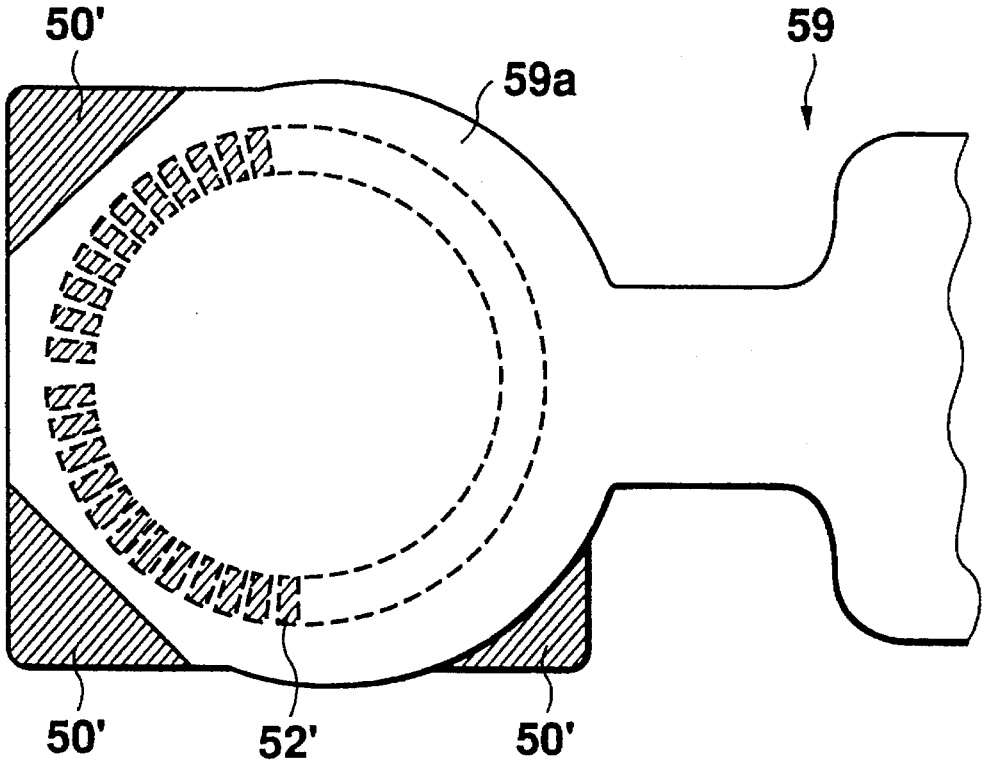
Fig. 5 (PRIOR ART)
FIG. 5 is a plan view of the tip portion of a flexible cable according to the prior art.
Figure 6:
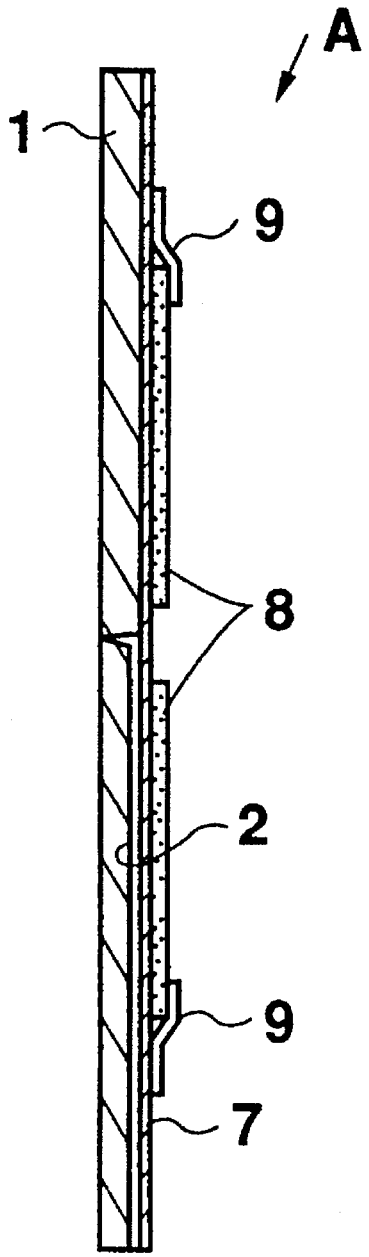
FIG. 6 is a cross-sectional view of a piezoelectric type head unit.
Figure 7:
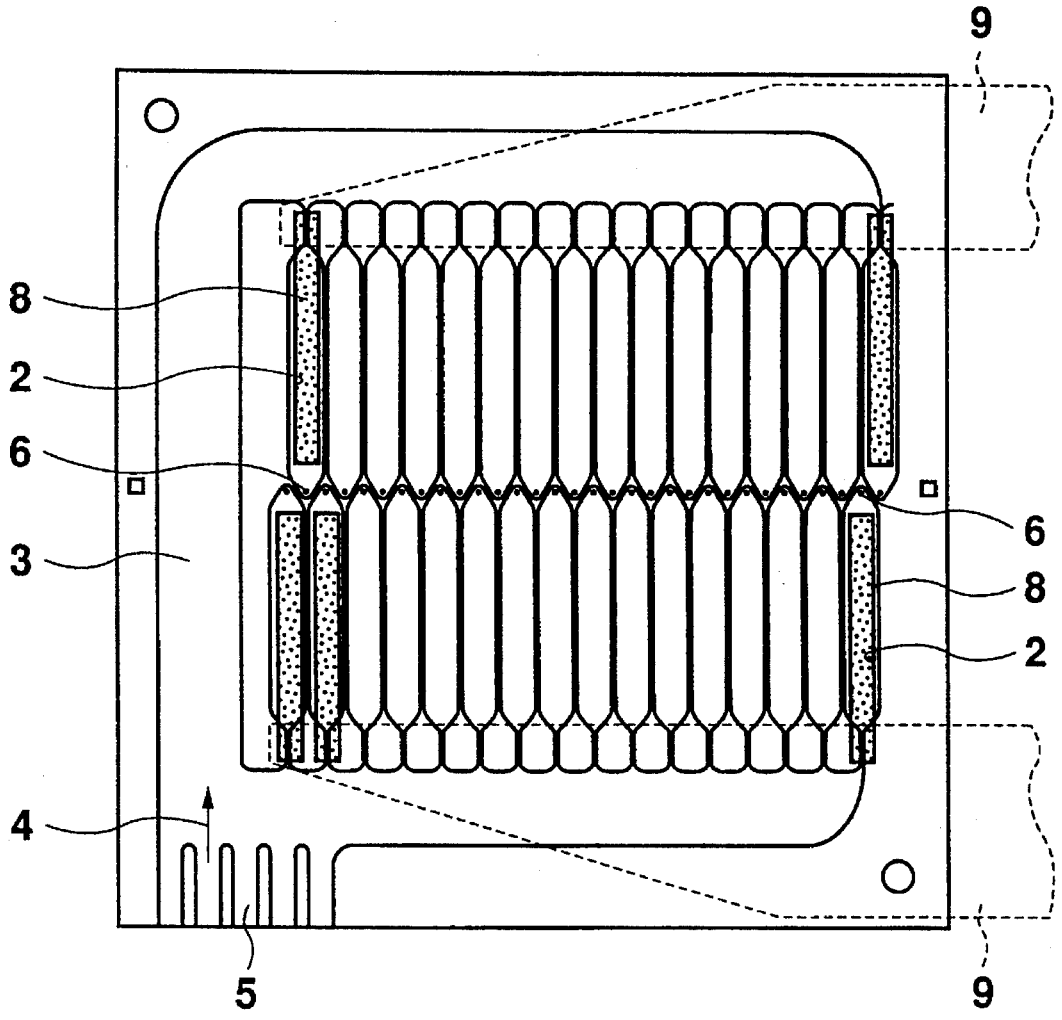
FIG. 7 is a plan view of the piezoelectric type head unit of FIG. 1.

Referring to FIGS. 6 and 7, there is shown one embodiment of a piezoelectric type head unit A constructed in accordance with the present invention, which comprises a base plate 1 of photosensitive glass, a plurality of pressure chambers 2 formed in the base plate 1, a common ink passage 3 formed in the base plate to communicate with the pressure chambers 2 and an ink inlet port 5 for supplying an ink 4 from an ink vessel (not shown) to the common ink passage 3, the pressure chambers, common ink passage and ink inlet port being formed in the base plate by any suitable means such as etching.

Each of the pressure chambers 2 has a tapered end which is juxtaposed relative to the tapered end of any adjacent pressure chamber. A plurality of nozzles 6 are formed through the base plate 1 perpendicular to the respective pressure chambers 2 at their tapered ends and arranged in a straight line.

A vibrating plate 7 is mounted on the surface of the base plate 1 in which the pressure chambers 2, common ink passage 3 and ink inlet port 5 are formed. The vibrating plate 7 has a common electrode which is formed of a single sheet of ITO or the like. The vibrating plate 7 has its outer wall on which a plurality of piezoelectric elements 8 of PZT or the like are independently mounted opposite to the respective pressure chambers 2. These piezoelectric elements 8 are connected to a signal generator (not shown) through the flexible cable 9.

Figure 8:
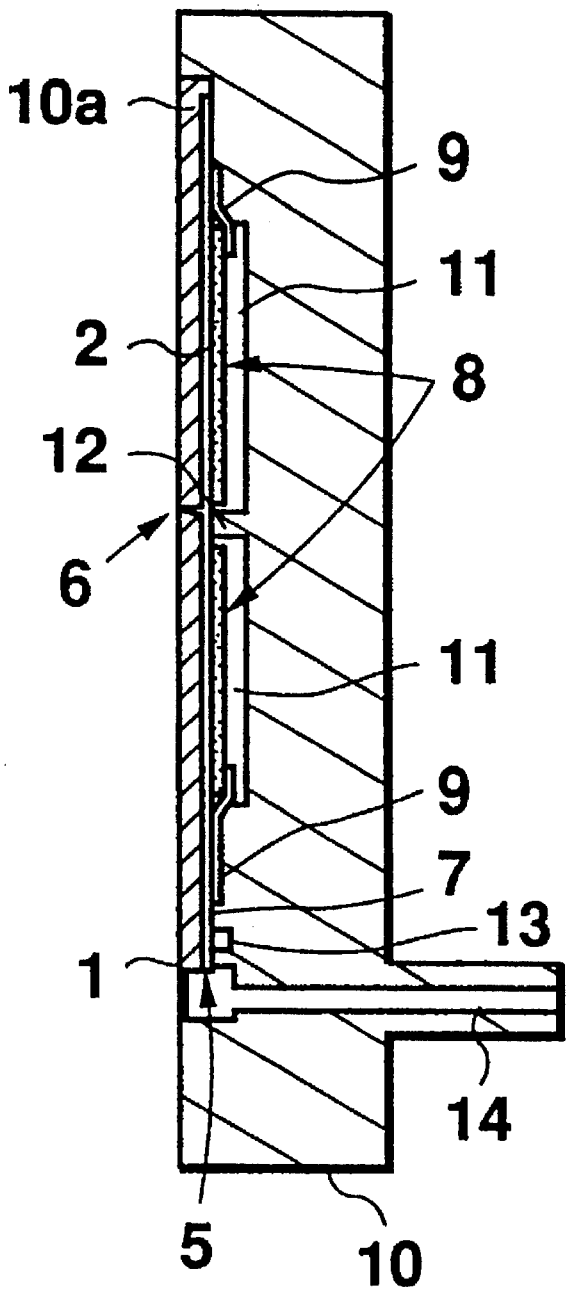
FIG. 8 is a view illustrating one embodiment of an inkjet print head in which the piezoelectric type head unit of FIG. 1 is mounted.

FIG. 8 is a cross-sectional view of the first embodiment of an inkjet print head constructed in accordance with the present invention in which the piezoelectric type head unit A as described is mounted. The base plate 1 of the piezoelectric type head unit A is placed within the recess 10*a* of a base 10 made of metal or high rigid plastic and fixed thereto through adhesive. The bottom of the recess 10*a* includes a plurality of smaller recesses 11 formed therein at positions corresponding to the respective piezoelectric elements 8 and a projection 12 formed therein for supporting the vibrating plate 7 at positions corresponding to the nozzles 6. The base 10 further includes a groove 13 for preventing the adhesive used to bond the base plate 1 to the base 10 from overflowing into an ink introducing passage 14 which is also formed in the base 10.

On operation, a voltage is applied to any necessary piezoelectric element 8 which in turn is deflected to deform the part of the vibrating plate 7 corresponding to that piezoelectric element 8. The deformation of the vibrating plate 7 varies the volume of the corresponding pressure chamber 2 to eject the ink therefrom through the corresponding nozzle 6. Since the part of the vibrating plate 7 corresponding to that nozzle 6 is supported by the projection 12, the other part of the vibrating plate 7 corresponding to a piezoelectric element adjacent to the deformed piezoelectric element will not be deflected.

After the ink has been injected and when the vibrating plate 7 returns to its original position, the amount of ink corresponding to that of the injected ink will be replenished into the pressure chamber from the common ink passage 3 through the ink introducing passage 14 and ink inlet port 5.

Figure 9:
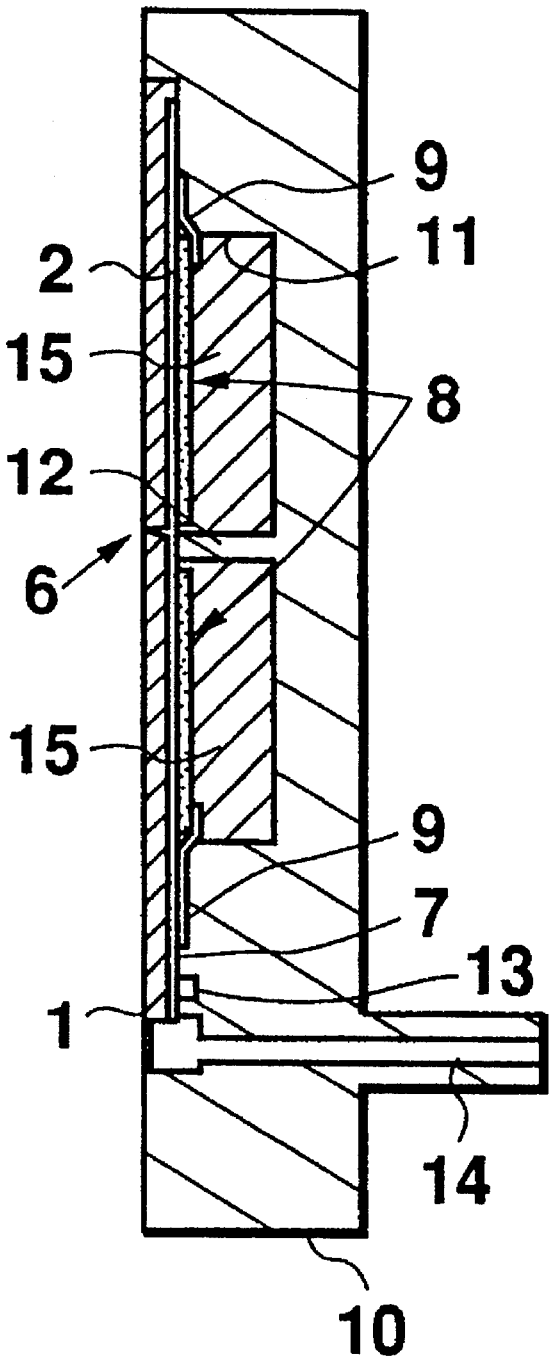
FIG. 9 is a view illustrating another embodiment of an inkjet print head in which the piezoelectric type head unit of FIG. 1 is mounted.

Referring next to FIG. 9, there is shown the second embodiment of an inkjet print head constructed in accordance with the present invention, which includes vibration dampers 15 of rubber or the like for preventing the vibrating plate 7 from being vibrated unnecessarily, each of the vibration dampers 15 being received in one smaller recess 11 shown in the first embodiment.

In the second embodiment, each of the vibration dampers 15 has a resonance frequency which is much smaller than that of the vibrating plate 7. Thus, the vibration damper 15 can effectively absorb the vibration in the vibrated part of the vibrating plate 7 for injecting the ink before such a vibration is transmitted to the other parts of the vibrating plate 7. This can reliably prevent erroneous resonance in the other not-selected vibrating plate parts.

Figure 10:
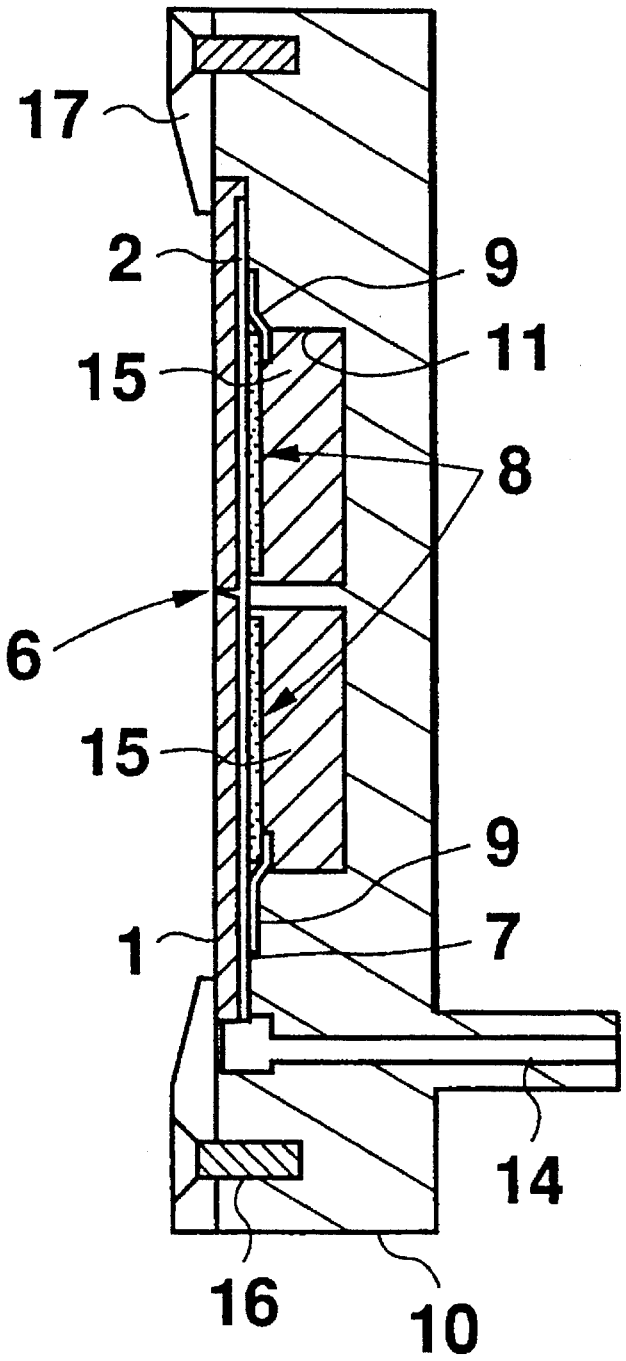
FIG. 10 is a view illustrating still another embodiment of an inkjet print head in which the piezoelectric type head unit of FIG. 1 is mounted.

The third embodiment of an inkjet print head constructed in accordance with the present invention will be described with reference to FIG. 10. In the third embodiment, the base plate 1 of the piezoelectric type head unit is more rigidly mounted on the base 10 by holding the outer periphery of the base plate 1 through a holding frame 17 which is threadedly screwed to the base 10 through machine screws 16, rather than through adhesive as in the first embodiment.

Figure 11:
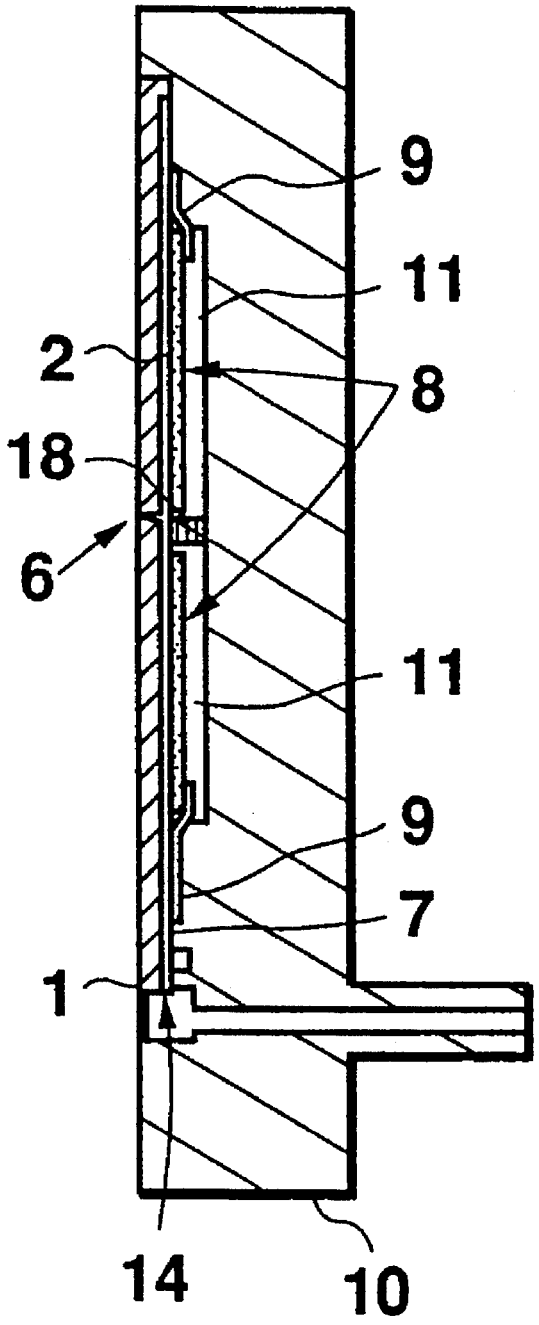
FIG. 11 is a view illustrating a further embodiment of an inkjet print head in which the piezoelectric type head unit of FIG. 1 is mounted.

The fourth embodiment of an inkjet print head according to the present invention will be described with reference to FIG. 11. In the fourth embodiment, the projection 12 as in the first embodiment is replaced by a resilient member 18 for effectively reducing any unnecessary vibration in the vibrating plate 7. Unlike the previous embodiments, the fourth embodiment requires any suitable means such as adhesive to fix the resilient member 18 to the base 10, but can more reliably absorb the vibration since the part of the vibrating plate corresponding to the nozzles is supported by the resilient member 18 under some resilient compression.

Figure 12:
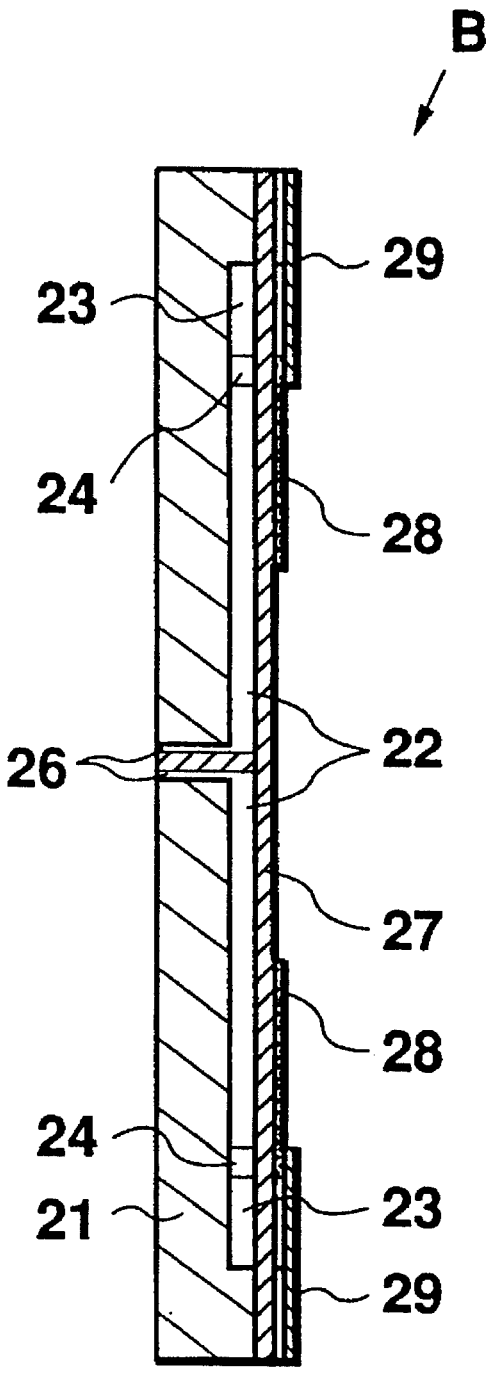
FIG. 12 is a cross-sectional view of a piezoelectric type head unit including a plurality of piezoelectric elements which are arranged in a circle.
Figure 13:
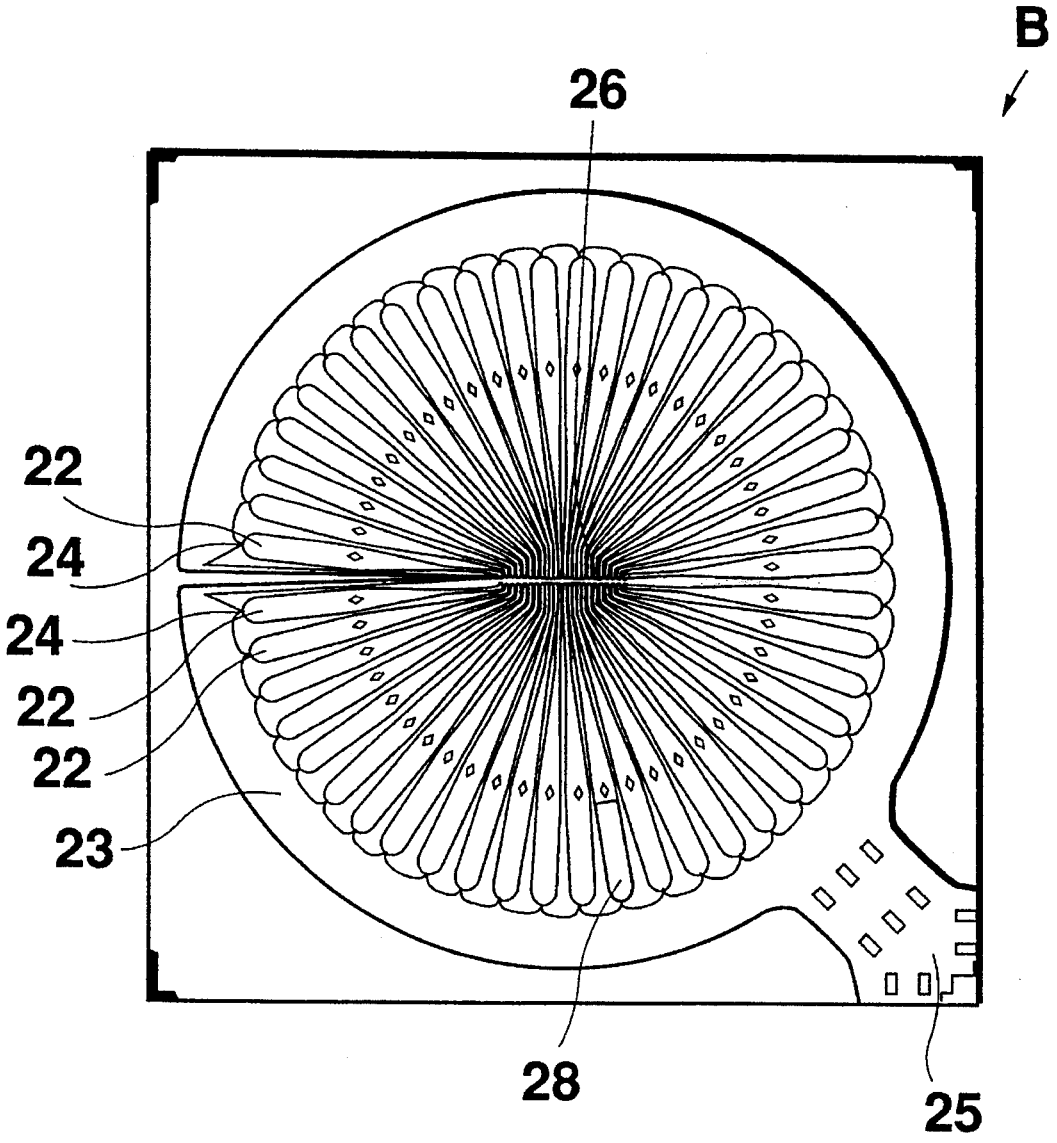
FIG. 13 is a plan view of the piezoelectric type head unit shown in FIG. 12.

FIGS. 12 and 13 shows the other structure of a head unit B in which piezoelectric elements and pressure chambers are arranged in a circle. The head unit B comprises a base plate 21 of photosensitive glass, a plurality of linear pressure chambers 22 radially formed to extend from the center of the base plate 21, a common ink passage 23 formed in the base plate 21 to surround and communicate with the pressure chambers 22 and an ink inlet port 25 formed in the base plate 21 for supplying the ink to the common ink passage 23, the pressure chambers, common ink passage and ink inlet port being worked through etching. A plurality of nozzles 26 are further formed through the base plate 21 at the ends of the pressure chambers 22 adjacent to the center of the base plate 21. The radial formation of the pressure chambers 22 can increase the number of nozzles per unit area.

Figure 14:
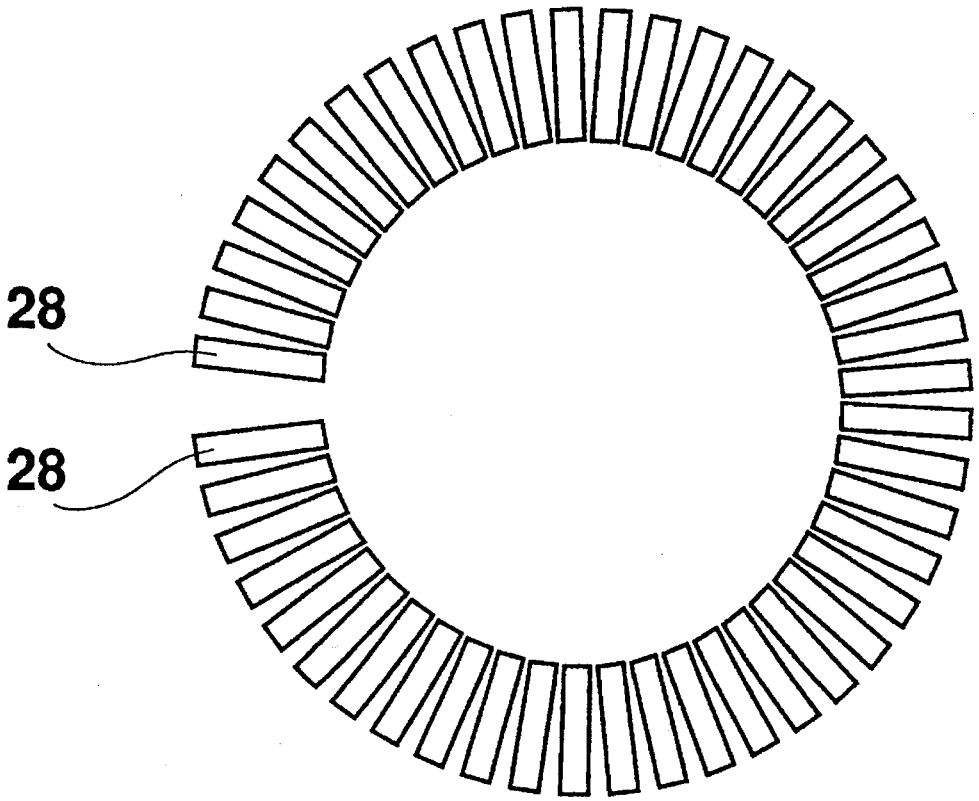
FIG. 14 is a view illustrating the layout of the piezoelectric elements in the piezoelectric type head unit shown in FIGS. 12 and 13.

The piezoelectric type head unit also comprises a vibrating plate 27 which may be made of glass. The vibrating plate 27 is attached to the surface of the base plate 21 in which the pressure chambers 22, common ink passage 23 and ink inlet port 25 are formed, through any suitable means such as machine screws or adhesive. The piezoelectric type head unit further comprises a plurality of piezoelectric elements 28 which may be made of PZT or the like and are mounted on the vibrating plate 27 at positions corresponding to the respective pressure chambers 22, the entire layout of the piezelectric elemetts 28 being shown in FIG. 14. The piezoelectric elements 28 are connected to a flexible cable 29 for applying a signal voltage from a signal generator (not shown) to the respective piezoelectric elements 28.

Figure 15:
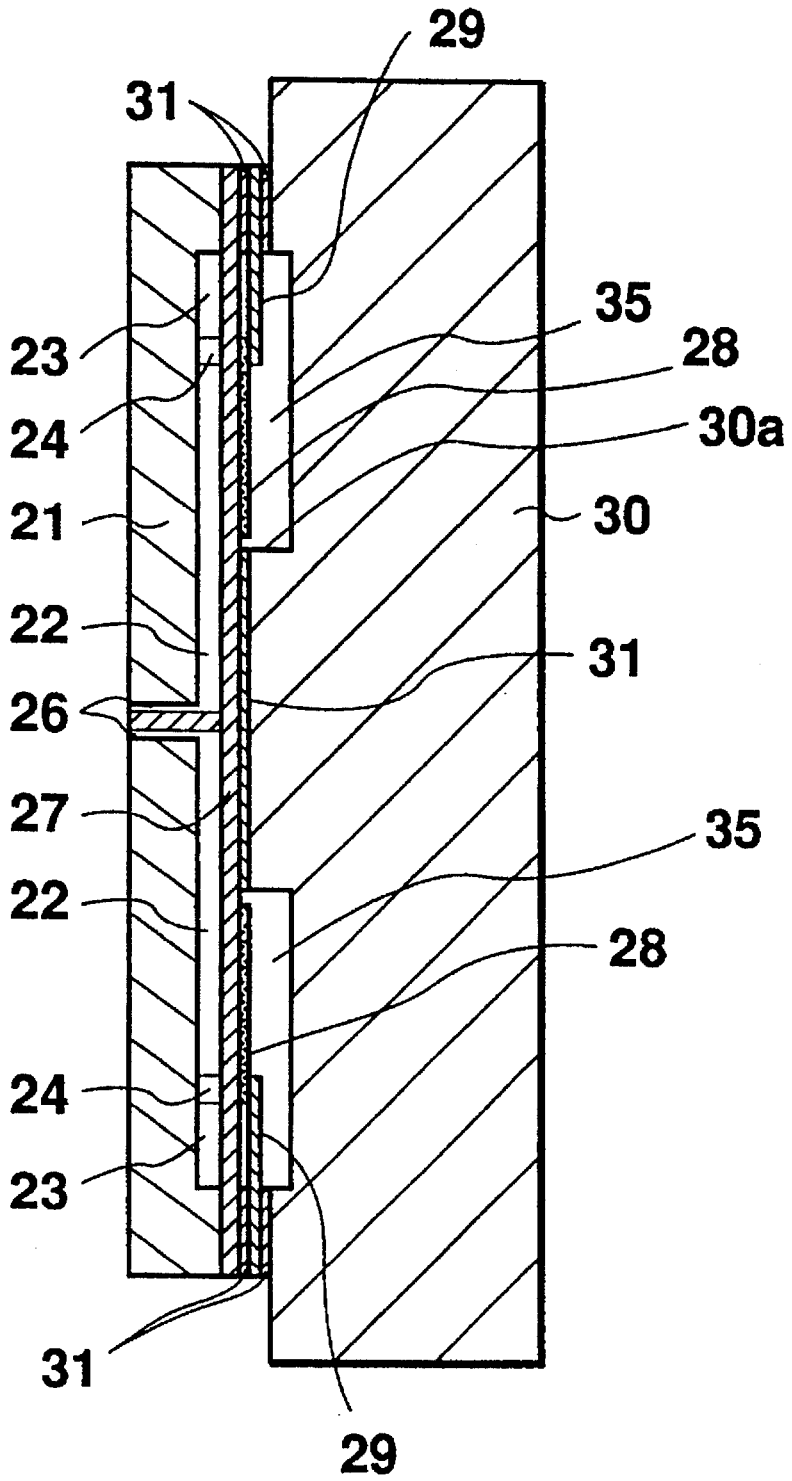
FIG. 15 is a view illustrating one embodiment of an inkjet print head in which the piezoelectric type head unit shown in FIGS. 12, 13 and 14 is mounted.

FIG. 15 shows the fifth embodiment of an inkjet print head constructed in accordance with the present invention in which the piezoelectric type head unit B as described is mounted. The inkjet print head comprises a base 30 made of metal or high rigidity plastic, recesses 35 formed in the base 30 at positions corresponding to the respective piezoelectric elements 28, and a projection 30*a* formed in the base 30 substantially at its center. The outer periphery and center of the vibrating plate 27 are bonded to the base 30 through adhesive 31.

On operation, a signal voltage is applied to any necessary piezoelectric element 28 which in turn is deflected to deform the part of the vibrating plate 27 corresponding to that piezoelectric element 28. The deformation of the vibrating plate 27 varies the volume of the corresponding pressure chamber to eject the ink therefrom through the corresponding nozzle 26. Since the part of the vibrating plate 27 corresponding to that nozzle 26 is supported by the projection 30*a* of the base 30, the other part of the vibrating plate 27 corresponding to a piezoelectric element adjacent to the deformed piezoelectric element will not be deflected.

After the ink has been injected and when the vibrating plate 7 returns to its original position, the amount of ink corresponding to that of the injected ink will be replenished into the pressure chamber 22 from the pressure chamber inlet 24 through the ink inlet port 25 and common ink passage 23. As in the second embodiment of FIG. 9, vibration dampers of rubber and the like may be interposed to reduce the vibration between the base 30 and the respective piezoelectric elements 28.

Figure 16:
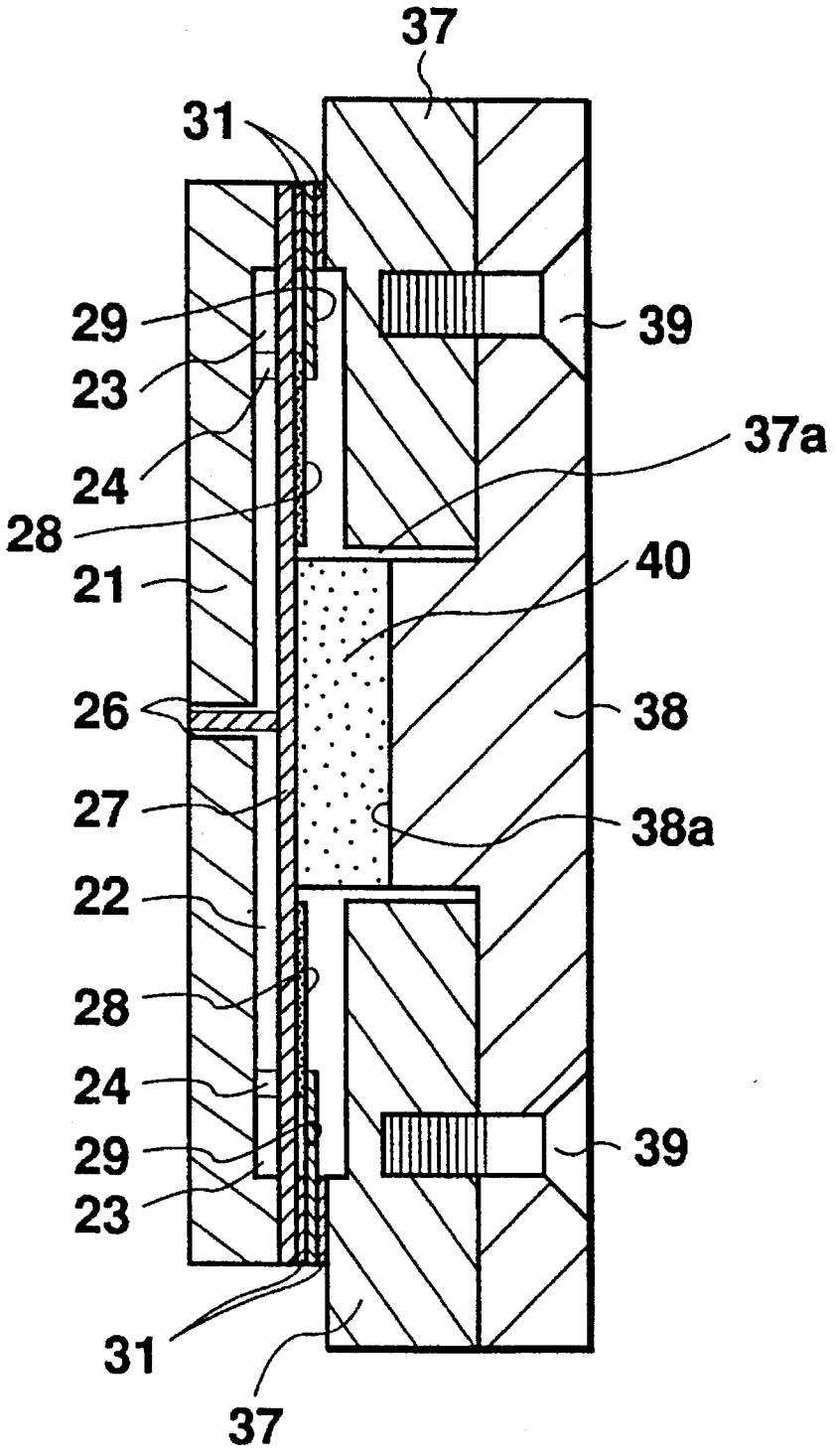
FIG. 16 is a view illustrating another embodiment of an inkjet print head in which the piezoelectric type head unit shown in FIGS. 12, 13 and 14 is mounted.

FIG. 16 shows the sixth embodiment of an inkjet print head according to the present invention, which comprises a first cylindrical base 37, a piezoelectric type head unit B attached to the first base 37 through adhesive 31 and a second base 38 rigidly connected to the first base 38 through machine screws 39. The second base 38 includes a substantially centrally formed projection 38*a*. A resilient member 40 of rubber or the like is interposed between the projection 38*a* and the vibrating plate 27. After the piezoelectric type head unit B has been mounted on the first base 37, the second base 38 is placed on the first base 37 with the projection 38*a* engaging in the central opening of the first base 37. The first and second bases 37, 38 are then integrally bonded to each other through the machine screws 39. Since the resilient member 40 of rubber or the like is located between the substantially central portion of the vibrating plate 27 and the projection 38*a*, any unnecessary vibration in the vibrating plate 27 can effectively be reduced.

Figure 17:
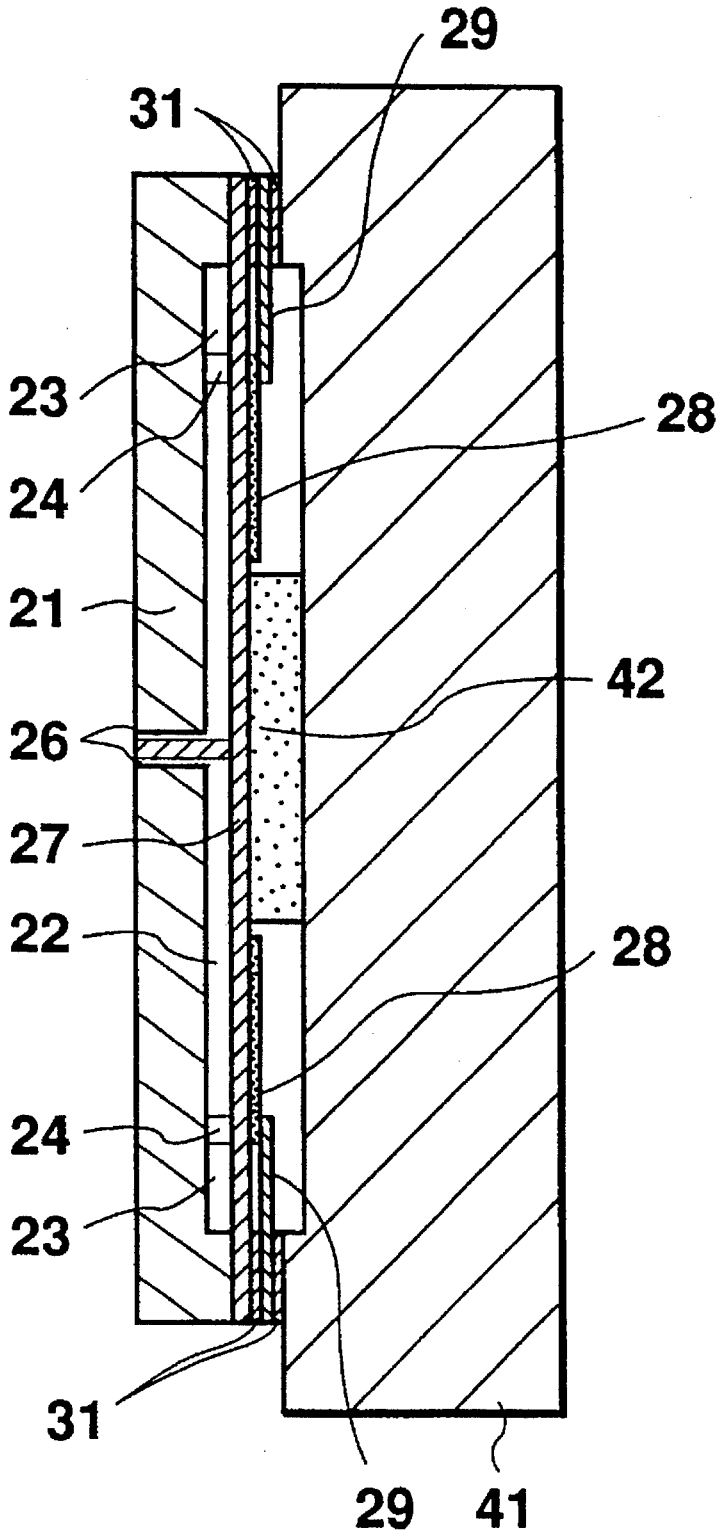
FIG. 17 is a view illustrating still another embodiment of an inkjet print head in which the piezoelectric type head unit shown in FIGS. 12, 13 and 14 is mounted.

The seventh embodiment will now be described. As shown in FIG. 17, an elastic member 42 is substituted for the projection 30*a* on the base 30 mentioned in connection with the 5th embodiment, which can also prevent unnecessary vibration of the vibrating plate 27 in the same manner as the 6th embodiment.

Figure 18:
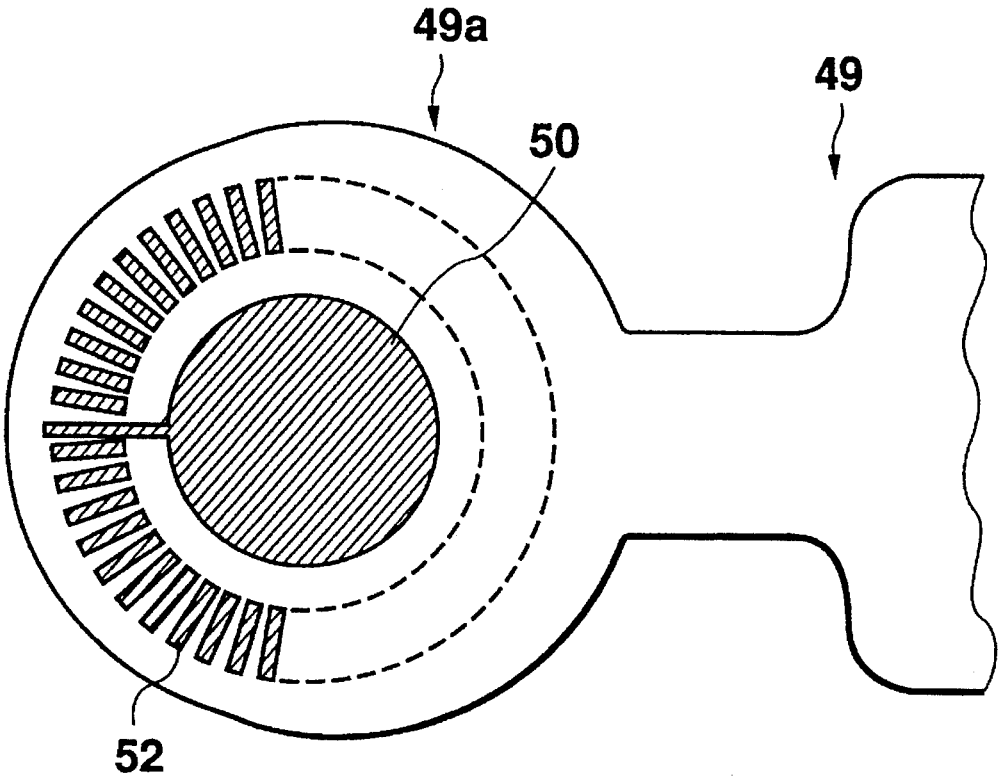
FIG. 18 is a plan view of the tip portion of a flexible cable in the inkjet print head.
Figure 19:
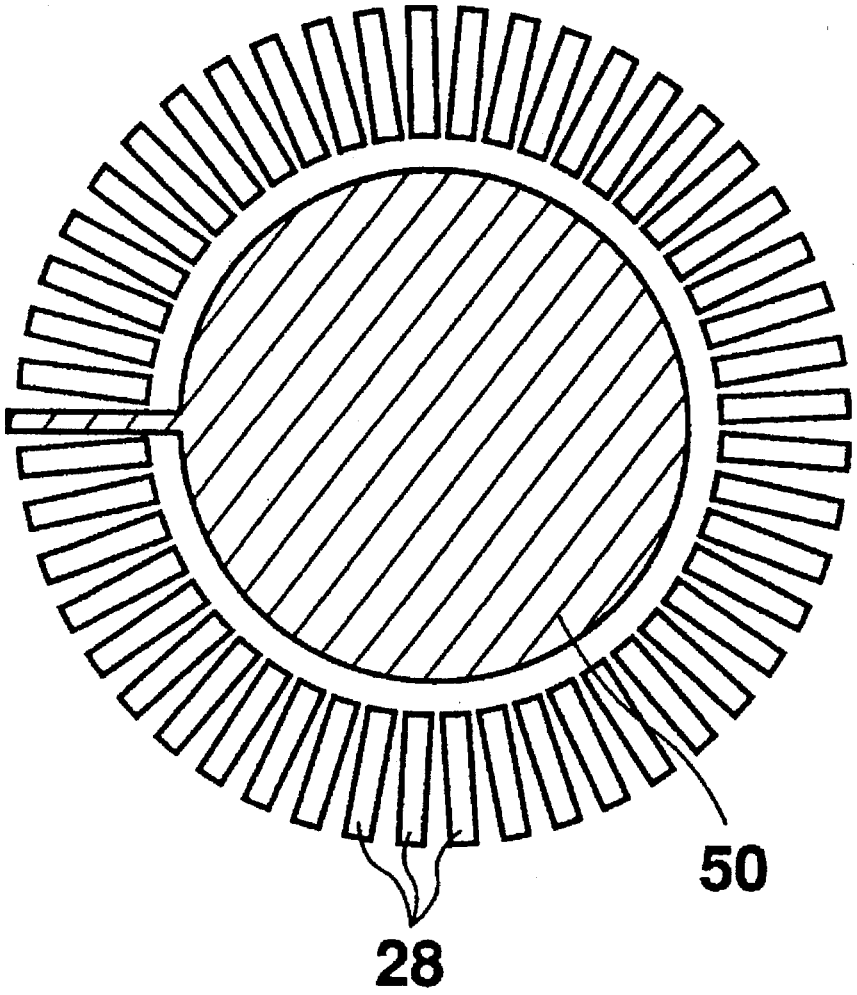
FIG. 19 is a view illustrating the positions of grounding electrodes in the inkjet print head.

Next, embodiments of an inkjet print head according to the present invention which comprise a flexible cable 49 covering the entire area of the vibrating plate including the piezoelectric elements, in the fifth embodiment, the sixth embodiment and the seventh embodiment, rather than the flexible cable 29 only contacting the ends of the piezoelectric elements 28 as in the previous embodiments, will be described. More particularly, the tip part 49*a* of the flexible cable 49 has a circular grounding electrode 50 which corresponds to a circular area defined by electrodes 52 for the piezoelectric elements, as shown in FIG. 18. Namely, the grounding electrode 50 will be located within the circular area formed by the circular array of piezoelectric elements 28, as can best be seen from FIG. 19.

Figure 20:
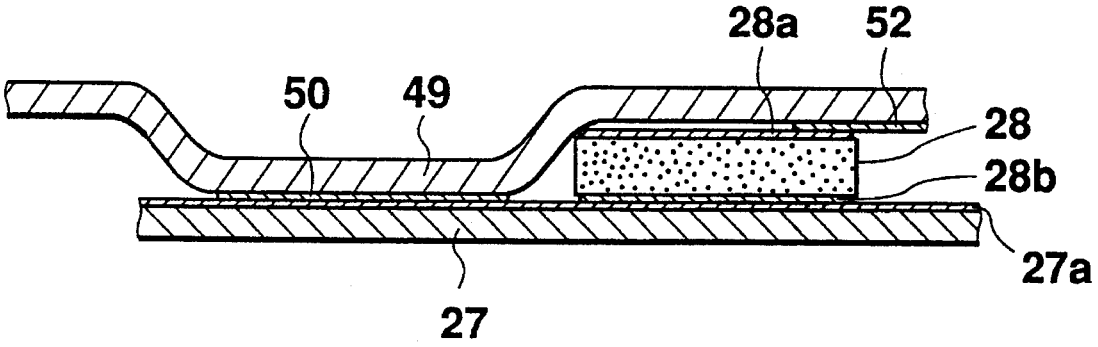
FIG. 20 is a cross-sectional view illustrating the primary parts of a piezoelectric type head unit using the flexible cable shown in FIGS. 18 and 19.

The connection between the piezoelectric element electrodes 52 and the grounding electrode 50 in the flexible cable tip part 49*a* will be described with reference to FIG. 20. Each of the piezoelectric element electrodes 52 in the flexible cable tip part 49*a* is disposed so as to be in contact with an electrode 28*a* in the top of the corresponding piezoelectric element 28. The piezoelectric element 28 also includes another electrode 28*b* located on the bottom thereof, the electrode 28*b* being defined to be in contact with the respective one of the electrodes 27*a* on the vibrating plate 27. The electrodes 27*a* of the vibrating plate 27 are connected to the circular grounding electrode 50 on the flexible cable tip part 49*a*. In such an arrangement, a voltage will be applied to a piezoelectric element across the positive electrode defined by the piezoelectric element electrode 52 and the negative electrode defined by the grounding electrode 50.

Since the flexible cable tip part 49*a* has the grounding electrode 50 located at a position corresponding to the circular area defined by the piezoelectric elements 28 as described, the area occupied by the grounding electrode can be increased and the "floating" in the grounding electrode can be prevented. Furthermore, the distance between the grounding electrode 50 and each of the piezoelectric element electrodes 52 can be reduced and equalized to maintain a constant voltage drop and to prevent the head from being heated. Therefore, the ink droplet discharge can be maintained with constant characteristics.

Figure 21:
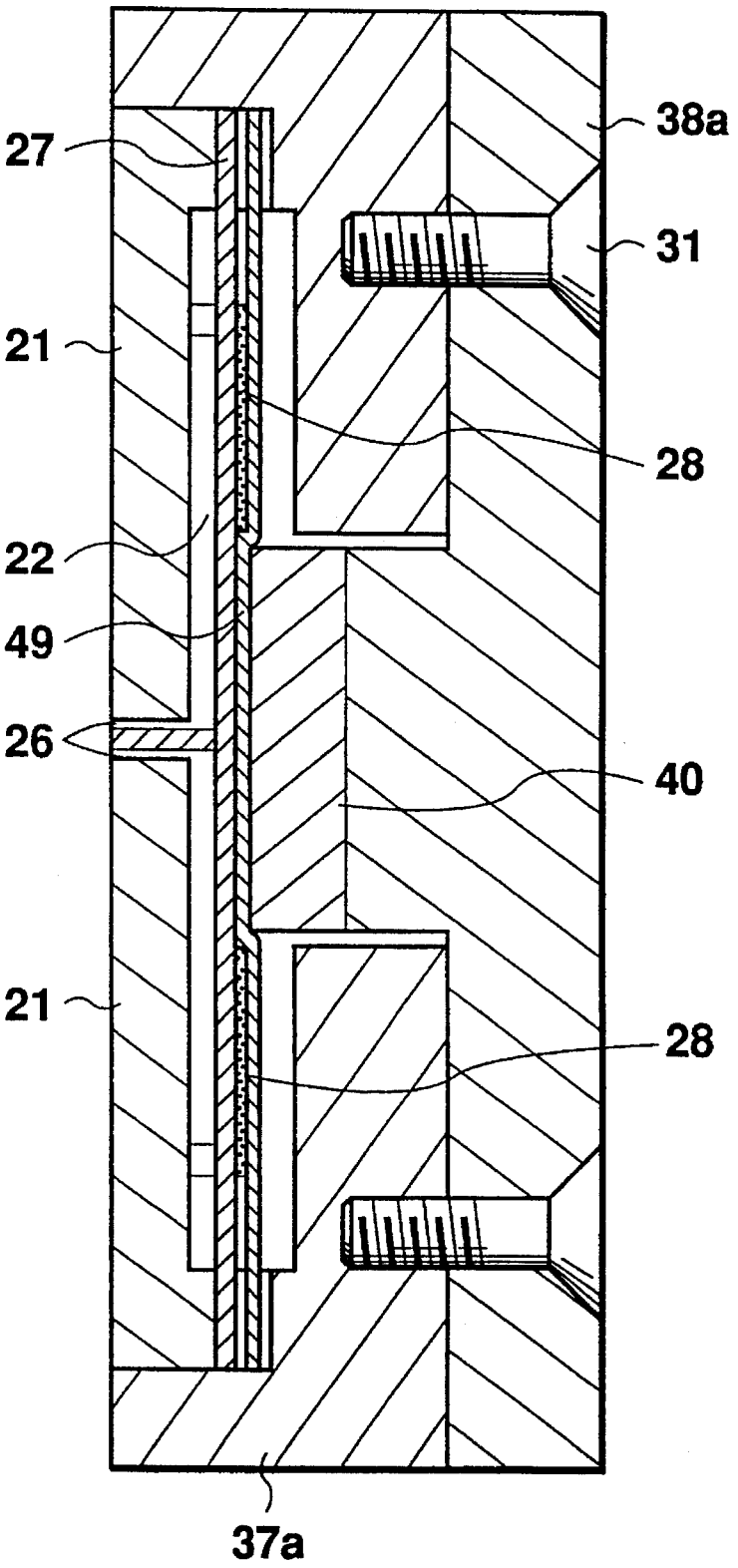
FIG. 21 is a cross-sectional view of the piezoelectric type head unit of FIG. 20 which is mounted on a base.

An embodiment of the head unit having the tip part 49*a* of the aforementioned flexible cable structure will be described with reference to FIGS. 21 and 13. This head unit includes the flexible cable tip part 49*a* which is similar to the tip part of the flexible cable 29 in the sixth embodiment shown in FIG. 16. The head unit also includes a base plate 21 of photosensitive glass, a number of pressure chambers 22 formed in the base plate 21, a common ink passage 23 formed in the base plate 21 to communicate with all the pressure chambers 22 and an ink inlet port 25 formed in the base plate 21 for supplying the ink from an ink vessel (not shown) to the common ink passage 23, the pressure chambers, common ink passage and ink inlet port all being formed through etching. Each of the pressure chambers 22 has one tapered end at which a nozzle 26 is formed through the base plate 21 in a direction perpendicular to the plane of that pressure chamber 22. The nozzles 26 are arranged in a linear array. A vibrating plate 27 is attached to the surface of the base plate 21 on which the pressure chambers 22, common ink passage 23 and ink inlet port 25 are formed. Piezoelectric elements 28 of PZT are independently located on the outer face of the vibrating plate 27 at a position opposite to the respective one of the pressure chambers 22. The tip part 49*a* of the flexible cable is located over the piezoelectric elements and vibrating plate 28, 27.

The head unit is mounted on a first base 37*a* which in turn is fixedly mounted on a second base 38*a* through machine screws 31. A resilient member 40 of rubber or the like is interposed between the second base 38*a* and the flexible cable tip part 49*a* to bias the grounding electrode of the flexible cable tip part 49*a* firmly against the vibrating plate 27. Thus, the floating in the grounding electrode can be prevented with any resonance in the vibrating plate 27.

In the fifth and seventh embodiment respectively shown in FIGS. 15 and 17, the flexible cable tip parts may be of a structure similar to that of the flexible cable tip part 49*a*, resulting in prevention of any unnecessary vibration with the floating in the grounding electrode to maintain a constant characteristic of ink droplet discharge constant. If the fifth embodiment of FIG. 15 has a flexible cable tip part similar to the flexible cable tip part 49*a*, any vibration damper of rubber or the like may be provided between the piezoelectric elements 28 and the base 30.

Figure 22:
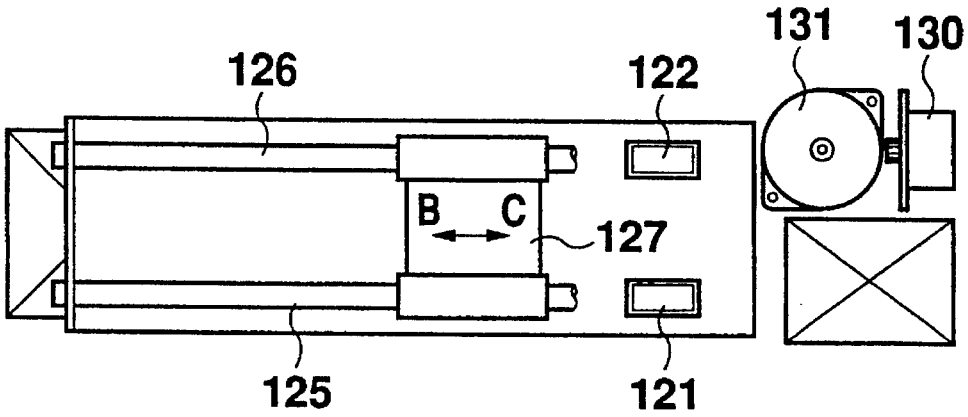
FIG. 22 is a plan view illustrating the primary parts of an inkjet printer in which a print head is mounted.
Figure 23:
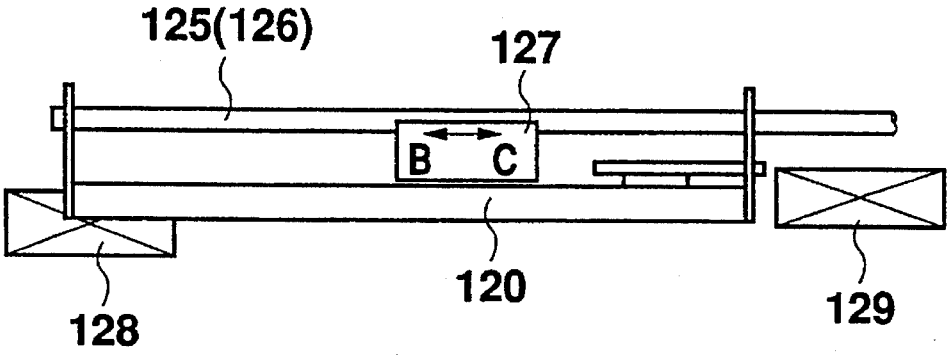
FIG. 23 is a front view illustrating the primary parts of the inkjet printer shown in FIG. 22.
Figure 24:
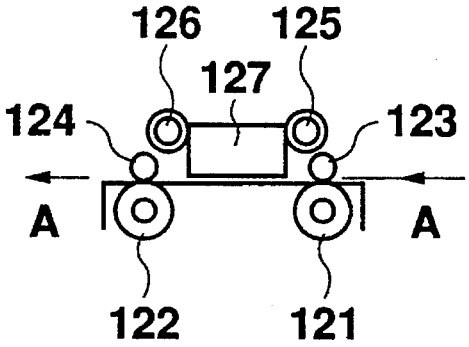
FIG. 24 is a side view illustrating the primary parts of the inkjet printer shown in FIGS. 22 and 23.

FIGS. 22 to 24 show the entire structure of an inkjet printer using an inkjet print head which is one of the inkjet print heads described hereinbefore. The inkjet printer comprises a flat platen 120 which helps in forming a small-sized and flattened structure such as facsimile, plotter or bar-code printer. A recording sheet (not shown) will be fed onto the flat platen 120 in a direction of arrow A as shown in FIG. 24. In order to perform a proper feed, the inkjet printer also comprises a pair of feed rollers 121 and 122 spaced away from each other in the direction of sheet movement. Each of the feed rollers 121 or 122 cooperates with an idle roller 123 or 124 to form a nip therebetween, through which nip the recording sheet will be fed by a given distance.

A pair of carriage guides 125 and 126 are disposed above the flat platen 120 and movably supports a carriage 127 for reciprocation in a direction perpendicular to the movement of the sheet. The carriage 27 is connected to a drive system (not shown) which may be in the form of any drive such as a step motor or the like for moving the carriage 27 to any position in the direction perpendicular to the movement of the sheet. Accordingly, the carriage 127 will be reciprocated in the direction of double-headed arrow BC in FIGS. 22 and 23.

The carriage 27 includes an inkjet print head as described in each of the previous embodiments, the nozzles thereof being positioned opposite to the recording sheet which has been conducted onto the platen 120. To supply the ink to the inkjet print head contained in the carriage 127, an ink cartridge 128 is located below the flat platen 120. The ink is supplied from the ink cartridge 128 to the ink inlet port of the inkjet print head through such means as a flexible tube.

A cleaning unit 129 is also provided in the inkjet printer for avoiding any solidification of ink in the nozzles when they are not used. When the printing is not performed, the carriage 127 causes the print head to retract toward the cleaning unit 129.

In order to perform the feed of the recording sheet and to drive the cleaning unit 129, the inkjet printer further includes a feed motor 130 which is adapted to transmit a driving force to the feed rollers 121, 122 and carriage 127 through the respective suitable power transmitting mechanisms (not shown).

Figure 25:
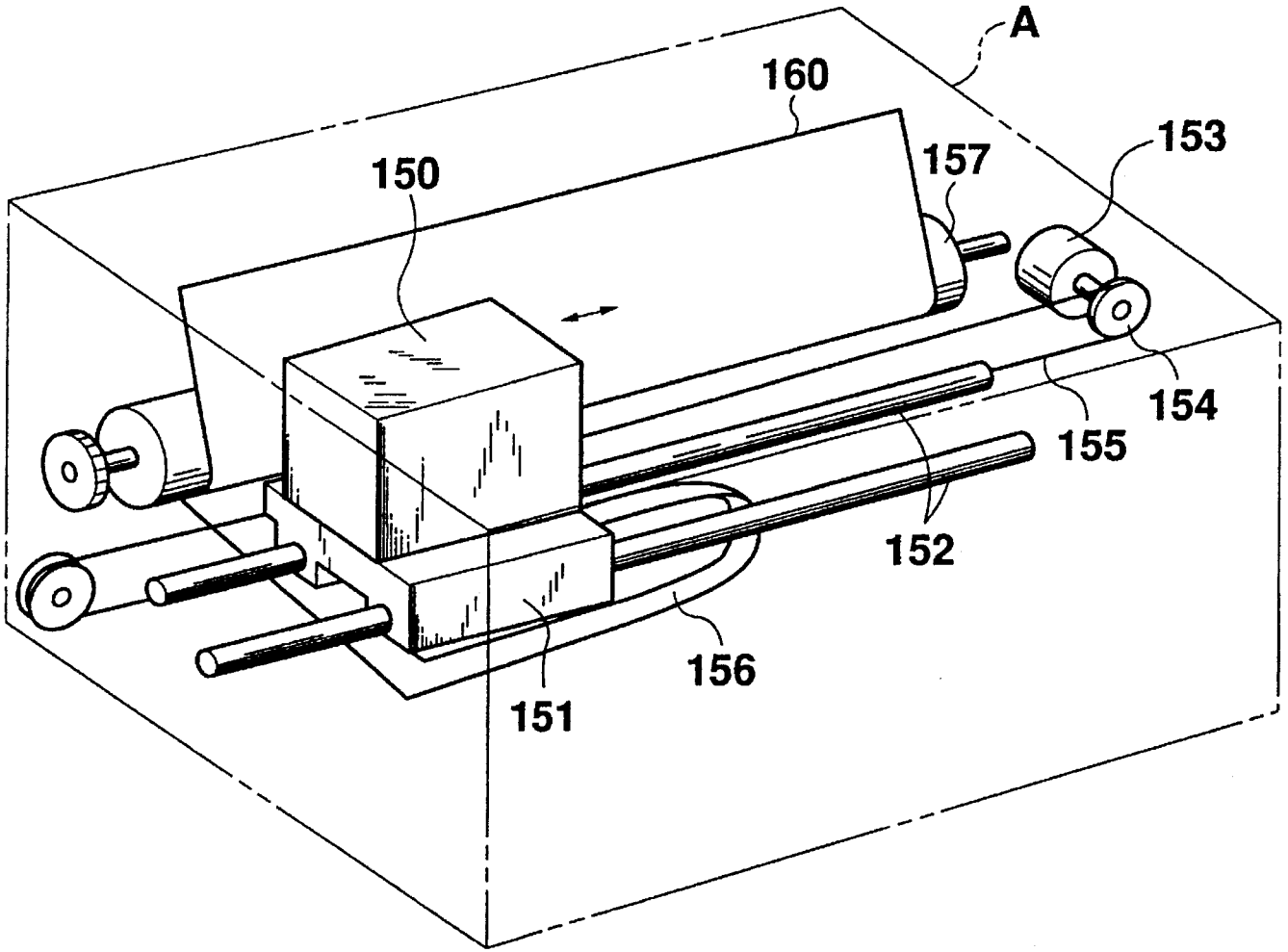
FIG. 25 is a perspective view illustrating the primary parts of the other embodiment of the inkjet printer.

FIG. 25 shows another inkjet printer in which an inkjet print head as described in each of the previous embodiments. The inkjet print head is mounted in a cartridge 150 which is disposed on a carriage 151. The carriage 151 is slidably mounted on two guides 152 and reciprocated in the direction perpendicular to the direction of recording sheet movement through a wire 155 which is spanned between a driven pulley 154 and an idler pulley, the driven pulley 154 being rotatably driven by a motor 153 to reciprocate the wire 155. The injection of ink from the inkjet print head is controlled by a flexible cable 56. The printing face of the cartridge 150 is positioned opposite to a recording sheet 160 wound around a platen 157 for printing.

We claim:

1. An inkjet print head comprising:

a head unit including:

a base plate having a plurality of nozzles, two arrays of pressure chambers extending in a surface of the base plate and being fluidly coupled to the respective nozzles, and a common ink passage fluidly coupled to said pressure chambers, a vibrating plate mounted on the surface of said base plate on which said pressure chambers are formed, the vibrating plate having an inner face facing the base plate and an outer face facing away from the base plate, and piezoelectric elements positioned against the outer face of said vibrating plate at locations opposite respective pressure chambers; and a base mounted to the head unit, said base facing the vibrating plate and the piezoelectric elements and having recessed portions at positions adjacent the pressure chambers so that the piezoelectric elements are intermediate the vibrating plate and the base in a direction perpendicular to the vibrating plate, the base further including a support member directly contacting and supporting the outer face of said vibrating plate at a position opposite the nozzles in said base plate.

2. An inkjet print head as defined in claim 1, further comprising a vibration damper intermediate said piezoelectric elements and said base.

3. An inkjet print head as defined in claim 2 wherein said vibration damper includes rubber.

4. An inkjet print head as defined in claim 1 wherein said support member is made of a resilient material.

5. An inkjet print head as defined in claim 2 wherein said support member is made of a resilient material.

6. An inkjet print head as defined in claim 3 wherein said support member is made of a resilient material.

7. An inkjet print head comprising:

a head unit including:

a base plate having a plurality of nozzles, a plurality of pressure chambers in a surface of the base place, the pressure chambers extending radially and being arranged in a circle surrounding said nozzles, a common ink passage fluidly communicating with all said pressure chambers, a vibrating plate mounted on the surface of said base plate, the vibrating plate having an inner face facing the base plate and an outer face facing away from the base plate, and piezoelectric elements positioned against the outer face of said vibrating plate at locations opposite respective pressure chambers; and a base mounted to the head unit, said base facing the vibrating plate and the piezoelectric elements and having recessed portions at positions adjacent the pressure chambers so that the piezoelectric elements are intermediate the vibrating plate and the base in a direction perpendicular to the vibrating plate, the base further including a support member directly contacting and supporting the outer face of said vibrating plate at a position opposite the nozzles in said base plate.

8. An inkjet print head as defined in claim 7, further comprising a vibration damper intermediate said piezoelectric elements and said base.

9. An inkjet print head as defined in claim 8 wherein said vibration damper is made of rubber.

10. An inkjet print head as defined in claim 7 wherein said support member is made of a resilient material.

11. An inkjet print head as defined in claim 8 wherein said support member is made of a resilient material.

12. An inkjet print head as defined in claim 9 wherein said support member is made of a resilient material.

13. An inkjet print head comprising:

a base plate formed with a plurality of nozzles, a plurality of pressure chambers arranged in a circle surrounding said nozzles, a common ink passage communicating with all said pressure chambers and an ink inlet port for supplying the ink to said common ink passage;

a vibrating plate mounted on a surface of said base plate;

piezoelectric elements located on an outer face of said vibrating plate at locations opposite respective pressure chambers; and a flexible cable including first electrode portions coupled to respective piezoelectric elements and a second common electrode portion located at a position within a circular area defined by said pressure chambers and said piezoelectric elements.

14. An inkjet print head as defined in claim 13, further including a base coupled to the base plate and facing said flexible cable, wherein said base includes a support member for supporting said vibrating plate at a position corresponding to the respective nozzles, the supporting member abutting said flexible cable.

15. An inkjet print head as defined in claim 13 further comprising a base coupled to the base plate and facing said flexible cable, and a vibration damper located between said piezoelectric elements and said base.

16. An inkjet print head as defined in claim 15 wherein said vibration damper is made of rubber.

17. An inkjet printer head as defined in claim 14 wherein said support member is made of a resilient material.

18. An inkjet print head as defined in claim 15, wherein said base includes a support member for supporting said vibrating plate at a position corresponding to the respective nozzles, the supporting member abutting said flexible cable, and wherein said support member is made of a resilient material.

19. An inkjet print head as defined in claim 16, wherein said base includes a support member for supporting said vibrating plate at a position corresponding to the respective nozzles, the supporting member abutting said flexible cable, and wherein said support member is made of a resilient material.

20. An inkjet printer comprising an inkjet print head as defined in claim 1.

21. An inkjet printer comprising an inkjet print head as defined in claim 7.

22. An inkjet printer comprising an inkjet print head as defined in claim 13.

23. An inkjet print head comprising:

a base plate having a plurality of pressure chambers arranged radially and extending from a central location, the pressure chambers being formed in a surface of the base plate;

a vibrating plate having an inner face that faces the surface of the base plate and an outer face that faces away from the base plate;

piezoelectric elements against the outer face of the vibrating plate at positions opposite respective pressure chambers; and a cable having individual first electrodes coupled to one side of the piezoelectric elements and a common second electrode positioned on an opposite side of the piezoelectric elements, the second common electrode being circular and generally centered on the central location.

24. The inkjet print head of claim 23, wherein the second electrode has a radius that is less than a distance from th central location to each of the first electrodes.

25. The inkjet print head of claim 23, wherein the base plate further includes a plurality of nozzles fluidly coupled to pressure chambers, the nozzles being disposed at the central location, the print head further including a base rigidly fixed to the base plate.

26. The inkjet print head of claim 25, wherein the cable covers the vibrating plate and the piezoelectric elements, wherein the base includes a support member that contacts the cable at a position opposite the second common electrode.

27. The inkjet print head of claim 26, wherein the base is made primarily from a rigid material, wherein the support member is an integral projection of the base.

28. The inkjet print head of claim 26, wherein the support member includes a resilient member attached to another part of the base.

29. The inkjet print head of claim 26, wherein the base has an annular member that surrounds the base plate and the vibrating plate.

30. An inkjet print head comprising:

a head unit including:

a base plate having a plurality of nozzles and a plurality of pressure chambers formed in a first surface of the base plate, the chambers being fluidly coupled to respective nozzles, a vibrating plate mounted against a surface of the base plate, the vibrating plate having an inner face facing the base plate and an outer face facing away from the base plate, and piezoelectric elements positioned against the outer face of said vibrating plate at positions corresponding to respective pressure chambers; and a base mounted to the head and having a surface that faces the vibrating plate and the piezoelectric elements, the base having recessed portions at positions corresponding to the pressure chambers such that the piezoelectric elements are intermediate the vibrating plate and the base plate, the base including a support member directly contacting the head unit at a location on the vibrating plate opposite the nozzles.

31. The inkjet print head of claim 30, wherein the support member is an integral projection of the base.

32. The inkjet print head of claim 30, wherein the support member includes a resilient member attached to a part of the base.

33. The inkjet print head of claim 30, wherein the chambers are arranged radially, wherein the nozzles are at a central location.

34. The inkjet print head of claim 30, wherein the chambers extend lengthwise in a first direction and are arranged along an axis perpendicular to the first direction.

35. The inkjet print head of claim 30, further including a vibration damper positioned between the base and the piezoelectric elements.

36. The inkjet print head of claim 30, wherein the base includes an annular portion surrounding the base plate and the vibrating plate, the annular portion having an annular surface that is coplaner to a second surface of the base plate.

37. The inkjet print head of claim 36, further including a frame member coupled to the base and flush with at least portions of the annular surface and the second surface of the base plate.

38. An inkjet print head comprising:

a base plate having a plurality of pressure chambers arranged radially from a central location, the pressure chambers being formed in a surface of the base plate;

a vibrating plate having an inner face that faces the surface of the base plate and an outer face that faces away from the base plate;

piezoelectric elements positioned against the outer face of the vibrating plate at positions opposite the pressure chambers; and a cable having individual first electrodes coupled to one side of respective piezoelectric elements and a common second common electrode positioned on an opposite side of the piezoelectric elements, the second electrode having a perimeter such that the second electrode is generally an equal distance to each of the piezoelectric elements.

* * * * *